US010431922B2

(12) United States Patent
Surana

(10) Patent No.: US 10,431,922 B2
(45) Date of Patent: Oct. 1, 2019

(54) PIN AND SLEEVE DEVICE WITH CONTACT CARRIER FOR CAPTURING SET SCREWS

(71) Applicant: Leviton Manufacturing Co., Inc., Melville, NY (US)

(72) Inventor: Gaurav Surana, Farmingdale, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 15/854,898

(22) Filed: Dec. 27, 2017

(65) Prior Publication Data

US 2019/0199031 A1 Jun. 27, 2019

(51) Int. Cl.

| | |
|---|---|
| ***H01R 13/502*** | (2006.01) |
| ***H01R 13/512*** | (2006.01) |
| ***H01R 13/64*** | (2006.01) |
| *H01R 4/30* | (2006.01) |
| *H01R 11/28* | (2006.01) |
| *H01R 9/05* | (2006.01) |
| *H01R 24/38* | (2011.01) |
| *H01R 33/76* | (2006.01) |

(52) U.S. Cl.

CPC ..... *H01R 13/512* (2013.01); *H01R 13/64* (2013.01); *H01R 4/30* (2013.01); *H01R 4/302* (2013.01); *H01R 9/0506* (2013.01); *H01R 11/283* (2013.01); *H01R 11/285* (2013.01); *H01R 11/287* (2013.01); *H01R 13/502* (2013.01); *H01R 24/38* (2013.01); *H01R 33/76* (2013.01)

(58) Field of Classification Search

CPC ... H01R 11/283; H01R 11/285; H01R 11/287; H01R 9/0506; H01R 24/38; H01R 33/76; H01R 13/502; H01R 4/30; H01R 4/302

USPC ..... 439/771, 579, 580, 682, 686, 801, 810, 439/813, 814

See application file for complete search history.

(56) References Cited

U.S. PATENT DOCUMENTS 3,390,369 A * 6/1968 Zavertnik ..... H01R 13/502 439/469
4,527,849 A * 7/1985 Marach ..... H01R 13/6271 439/347
4,669,806 A * 6/1987 Fuchs ..... H01R 4/363 439/712

OTHER PUBLICATIONS

"Watertight Pin and Sleeve Devices", 2010, Leviton, PK-93597-10-02-4D, p. 2 (Year: 2010).*
"Pin & Sleeve", 2016, Leviton, IEC 60309 Series I & II for North American & International Applications, p. 4 (Year: 2016).*

(Continued)

*Primary Examiner* — Abdullah A Riyami
*Assistant Examiner* — Justin A Kratt

(57) ABSTRACT

A pin and sleeve device including a contact carrier with captive set screws is disclosed. In some embodiments, the pin and sleeve device includes a housing and a contact carrier. The contact carrier may include a plurality of contact openings each receiving a terminal, such as a pin or a contact sleeve. The contact carrier may include a tool opening or slot extending from an outer surface or perimeter thereof. The tool opening or slot being in communication with one of the contact openings and/or terminals. A set screw may be positioned within the contact openings, the set screw positioned directly adjacent a retainment wall defining an inner portion of the contact openings. The contact carrier may therefore reduce the likelihood that the set screw may be lost or dropped, as the retainment wall is configured to prevent the set screw from passing through or exiting the tool opening or slot.

22 Claims, 6 Drawing Sheets

(56) References Cited

OTHER PUBLICATIONS

Pin & Sleeve, Plugs, Connectors, Inlets, Receptacles, Mechanical Interlocks and Accessories, IEC 60309 Series I & II for North American & International Applications Brochure, Leviton Manufacturing Co., Inc., 2016, www.leviton.com, pp. 1-36.
Pin and Sleeve Devices, Mechanical Interlocks, Section E Brochure, Hubbell Wiring Device-Kellems, www.hubbell-wiring.com, pp. 1-40.
Pin and Sleeve Devices IEC309 Brochure, Cooper Crouse Hinds, updated Mar. 2009, www.cooperindustries.com, pp. 1-20.
International Search Report and Written Opinion for the International Patent Application No. PCT/US2018/066516, dated Feb. 15, 2019.

* cited by examiner

PIN AND SLEEVE DEVICE WITH CONTACT CARRIER FOR CAPTURING SET SCREWS

FIELD OF THE DISCLOSURE

The present disclosure relates generally to a pin and sleeve device and, more particularly, to a pin and sleeve device with a contact carrier for capturing set screws.

BACKGROUND OF THE DISCLOSURE

Pin and sleeve devices such as, for example, plugs, connectors, receptacles, inlets, etc., are one type of device for carrying electrical power, and may be suitable for secure electrical connections in extreme or high-abuse environments. For example, pin and sleeve devices allow power delivery protected from moisture, dirt, etc. In some examples, pin and sleeve devices may be used to supply power equipment like welders, compressors, conveyors, portable tools, portable lighting, etc. Pin and sleeve devices may be especially appropriate for carrying high-current power sources to equipment in wet or corrosive environments. Depending on the application, pin and sleeve devices provide standardized designs rated at, for example, 60 A, 100 A, 125 A, 200 A, etc.

Standard pin and sleeve devices used to transmit electrical power typically are comprised of a male plug having "pins" and a female connector or receptacle, which may be connected to an electrical power source. The female connector typically includes mating sleeve-like contacts ("contact sleeves") for contacting and receiving the pins. Some form of latching may be provided to prevent accidental separation of the male and female devices. Thereafter, electrical connection is made through the mechanical insertion of the plug pins into the receptacle contact sleeves. For safety reasons, the receptacle contact sleeves are not energized or accessible unless a mating plug is properly and fully inserted.

Standard pin and sleeve devices may include wiring terminations, which may include channels to allow easy insertion and separation of electrical wires. Set screws may be used to provide a reliable connection and to ease the tightening of the wiring terminations to secure the electrical wires with respect to the pins or contact sleeves. Current pin and sleeve devices attach the set screws to an outer surface of a contact carrier such that the screw head is located external to the contact carrier for ease of manipulation by a technician. However, unless the set screw is fully rotated into the contact carrier, the set screw may become loose and thus prone to loss in the field.

Thus, it would be desirable to provide a contact carrier for use in a pin and sleeve device that prevents the set screws from being disconnected from the contact carrier, while also allowing easy external access to the set screws by a tool to tighten and loosen the individual set screws as required.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The present disclosure is directed to a pin and sleeve device with integrated contact carrier set screws. In one embodiment, the pin and contact sleeve device may include a housing and a contact carrier within the housing. The contact carrier may include a plurality of contact openings each receiving a terminal, the contact carrier may further include a tool opening extending between an outer perimeter and a first contact opening of the plurality of contact openings. The pin and sleeve device may also include a set screw positioned within the first contact opening of the plurality of contact openings. The set screw may be positioned directly adjacent a retainment wall defining a portion of the first contact opening of the plurality of contact openings, the retainment wall operable to prevent the set screw from passing through the tool opening.

In another embodiment, the present disclosure is directed to a contact carrier of a pin and sleeve device. The contact carrier may include a contact opening receiving a terminal, a tool slot extending from an outer circumferential perimeter to the contact opening, and a screw retainer defining a screw access channel aligned with the tool slot, the screw retainer including a contoured surface and a retainment wall defining an inner portion of the contact opening, wherein a set screw is positioned within the contact opening, directly adjacent the retainment wall and the contoured surface, and wherein the set screw is positioned entirely within the outer circumferential perimeter.

In another embodiment, the present disclosure is directed to a pin and sleeve device including a housing, a contact carrier located within the housing, and a set screw. The contact carrier may include a contact opening receiving a contact sleeve, a tool slot extending from an outer circumferential perimeter to the contact opening, and a screw retainer defining a screw access channel aligned with the tool slot, the screw retainer including a contoured surface and a retainment wall defining an inner portion of the contact opening. The set screw may be positioned within the contact opening and the screw access channel, the set screw positioned directly adjacent the retainment wall and the contoured surface, the retainment wall operable to prevent the set screw from entering into the tool slot.

BRIEF DESCRIPTION OF THE DRAWINGS

By way of example, specific embodiments of the disclosed device will now be described, with reference to the accompanying drawings, in which.

Figure 1:
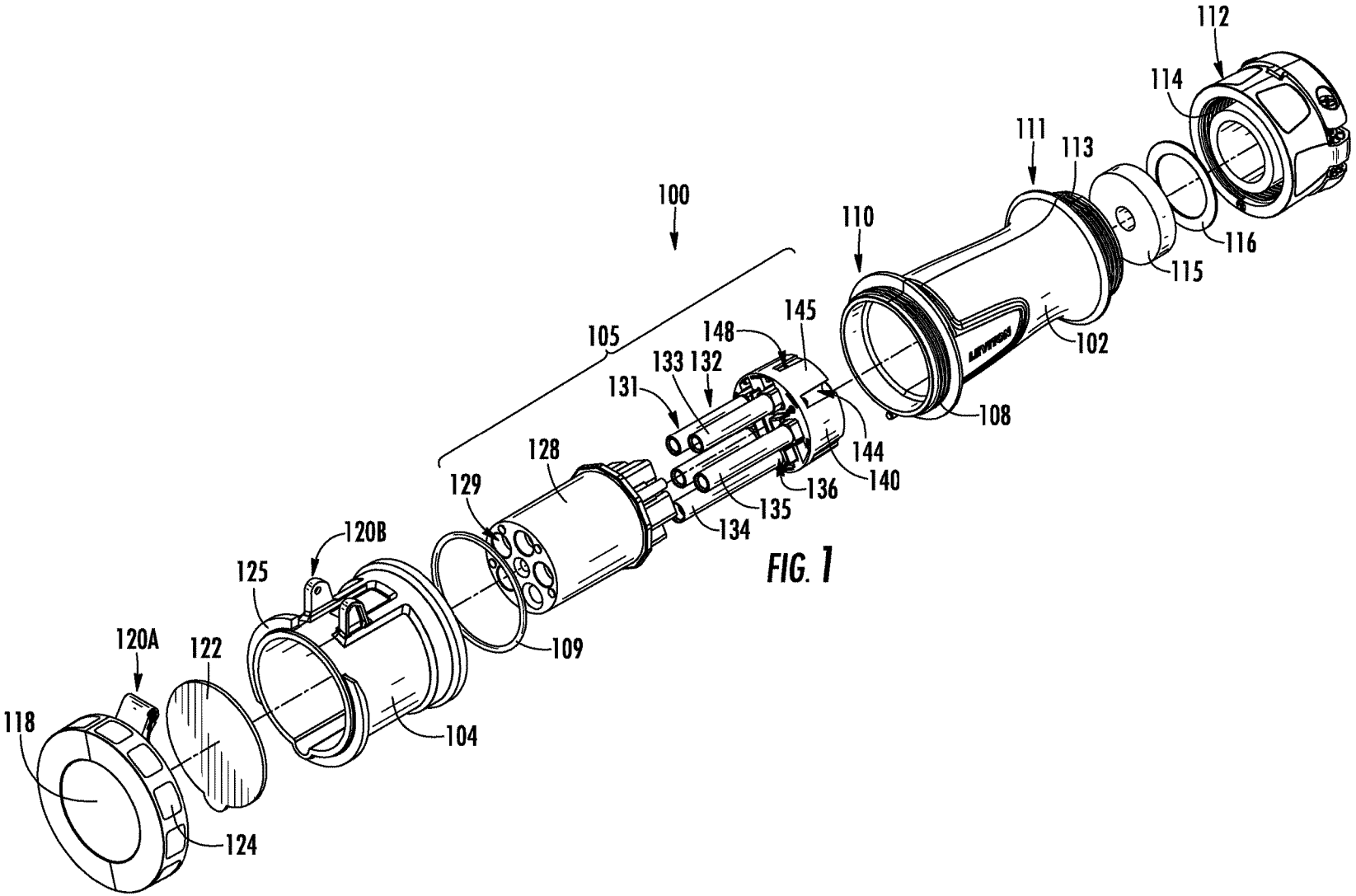
FIG. 1 is an exploded perspective view of one example embodiment of a pin and sleeve device according to embodiments of the present disclosure.

The drawings are not necessarily to scale. The drawings are merely representations, not intended to portray specific parameters of the disclosure. The drawings are intended to depict exemplary embodiments of the disclosure, and therefore are not to be considered as limiting in scope. In the drawings, like numbering represents like elements.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Various approaches in accordance with the present disclosure will now be described more fully hereinafter with reference to the accompanying drawings, in which preferred embodiments of the device, system and method are shown. The disclosed approaches may be embodied in many different forms and should not be construed as being limited to the embodiments set forth herein. Rather, these embodiments are provided so that this disclosure will be thorough and complete, and will fully convey the scope of the devices, system and method to those skilled in the art. In the drawings, like numbers refer to like elements throughout.

The present disclosure relates to pin and sleeve devices including a contact carrier for capturing individual set screws to reduce or eliminate the risk that the set screws will fall out and be lost in the field. To address the deficiencies identified above with standard pin and sleeve devices, the pin and sleeve devices of the present disclosure include a contact carrier for capturing each individual set screw within a tool opening or slot in communication with a terminal (e.g., contact sleeve, pin, etc.). Unlike set screws of standard pin and sleeve devices, which position the screw head outside of the contact carrier, the set screws of the present disclosure are prevented from extending beyond an outer perimeter of the contact carrier.

In one embodiment, the pin and sleeve device may be a 60 A, 5-wire connector assembly for use in demanding environments. Other pin and sleeve devices may include industrial grade plugs, inlets, receptacles, which are also referred to as socket outlets, and mechanical interlocks, all of which are designed to provide safe, dependable performance in extreme environments. Although not limited herein, the pin and sleeve devices may achieve IP67 and IP69K enclosure ratings, with current ratings from approximately 20-100 A. Furthermore, the pin and sleeve devices may provide at least two different ingress protection ratings, for example, IP44 splash proof, or IP67 watertight and dust-tight, with current ratings from approximately 16-125 A. It should be understood that while the present disclosure is described in terms of, and illustrates, a particular type of pin and sleeve device, the disclosure should not be so limited. The contact carrier of the present disclosure and the principles thereof may be used in connection with any pin and sleeve device now known or hereafter developed including inlets, receptacle, plug, connectors, etc.

In some embodiments, a pin and sleeve device may include a housing and a carrier assembly within the housing. The carrier assembly may include a contact carrier including a plurality of contact openings, each contact opening being in communication with an electrical terminal such as, for example, a pin, a contact sleeve, etc. depending on the type of pin and sleeve device being manufactured. The contact carrier may include a tool opening or slot (used interchangeably herein without the intent to limit) extending from an outer side surface or outer perimeter thereof. The tool opening being in communication with one of the contact openings of the plurality of contact openings, and hence in communication with the electrical terminal. A set screw may be positioned within each contact opening. The set screw may be positioned directly adjacent a retainment wall defining a portion of each contact opening. The retainment wall is oriented and dimensioned to prevent the set screw from passing therethrough (e.g., exiting, or even entering), the tool slot. As a result, the set screw is held captive within the contact carrier, making it less likely to be lost during wire attachment and/or detachment.

In some embodiments, the pin and sleeve devices of the present disclosure may include a screw retainer, which is a structure within the contact carrier configured to hold the set screw captive therein. The screw retainer may include a screw access channel aligned with the tool slot, the screw retainer including a contoured surface to support the set screw. The screw retainer may further include a pair of sidewalls extending from the contoured surface, wherein the pair of sidewalls extend parallel to one another on opposite sides of the set screw. As a result, the set screw is further held in position within the contact carrier. To ensure that the set screw doesn't slip out of the contact carrier, a distance between a pair of access channel sidewalls defining the screw access channel may be designed to be less than a diameter of widest point of the set screw. As such, the set screw will not be permitted to move past the retainment wall and out of the tool slot.

Although not limited to any particular type of mechanical tightening device, the pin and sleeve device may include a set screw having external threading extending between a first end and a second end. The first end of the set screw may be located deeper into the contact carrier, as measured from an exterior circumferential perimeter thereof, the first end engaging an internally threaded surface of the contact sleeve. In exemplary embodiments, the second end of the set screw includes a drive, such as an internal socket drive, aligned with the tool slot. The drive may be accessible by a tool via the tool slot to permit an operator to rotate the set screw while wiring the pin and sleeve device.

Although embodiments hereinafter will be described with respect to an electrical connector assembly, it will be appreciated by one of ordinary skill that the contact carrier and captive set screws of the present disclosure may also be applicable for use in, without limitation, plugs, inlets, receptacles, and mechanical interlocks.

Figure 2:
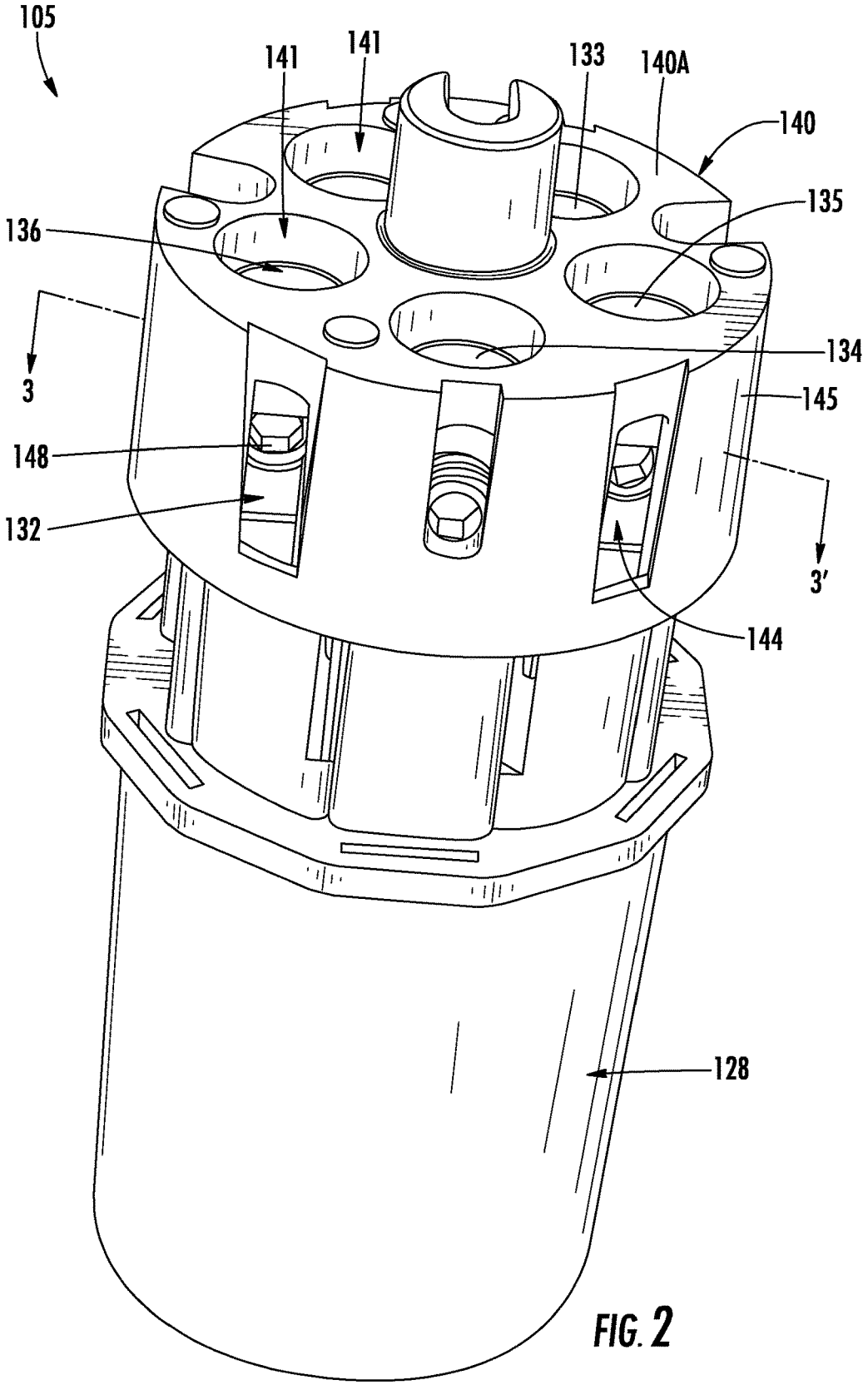
FIG. 2 is a side perspective view of one example embodiment of a carrier assembly for use with the pin and sleeve device of FIG. 1 according to embodiments of the present disclosure.

Referring now to FIGS. 1-2, an exemplary embodiment of a pin and sleeve device 100 in accordance with the present disclosure will be described in greater detail. FIG. 1 illustrates the pin and sleeve device (hereinafter "device") 100, while FIG. 2 illustrates a carrier assembly 105 of the device 100. In some embodiments, the device 100 may be a connector, such as an electrical connector, and may include one or more housing components, such as a main housing 102 coupleable with a front housing 104. In some embodiments, the main housing 102 and the front housing 104 are secured together via a mechanical attachment, such as, but not limited to, an external threading 108 along a first end 110 of the main housing 102 and corresponding inner threading (not shown) on the front housing 104. In some embodiments, an o-ring 109 may be provided at the intersection of the main housing 102 and the front housing 104 to form a seal against moisture and contaminants. The main housing 102 and the front housing 104 may provide protection from abuse and environment, including in low-to-high ambient temperature extremes (e.g., −40° C. to 60° C.). In some embodiments, the main housing 102 and the front housing 104 are made of impact modified nylon, an insulative material resistant to impact, heat, flame, and chemicals, although it is envisioned that the housing may be made from any other suitable material such as, for example, polybutylene terephthalate (PBT).

As further shown, a second end 111 of the main housing 102 may be coupled to a saddle clamp 112 via a mechanical attachment, such as, but not limited to, an external threading 113 on the main housing 102 and corresponding internal threading 114 on the saddle clamp 112. In some embodiments, the saddle clamp 112 may include a housing grommet 115, such as a watertight chloroprene onion skin grommet, and a clamp washer 116. The housing grommet 115 and the clamp washer 116 prevent moisture, dust, and contaminants from entering the second end 111 of the main housing 106. The solid chloroprene of the housing grommet 115 may provide a positive seal and excellent chemical/corrosion-resistance. In some examples, the onion skin design on the housing grommet 115 provides a precise watertight fit, eliminating the need to choose from multiple grommets that may not fit the cable jacket precisely.

The front housing 104 may further include a connector lid 118 mechanically secured thereto by, for example, mating hinge components 120A, 120B. The connector lid 118 may include a gasket 122 and a locking ring 124. The locking ring 124 may include one or more internal locking features (e.g., tabs) operable to engage a corresponding mechanical locking feature (e.g., a semi-helical ridge) 125 of the front housing 104 when the front connector lid 118 and the front housing 104 are rotated relative to one another. In some embodiments, the connector lid 118 may be a spring-loaded cover, which closes automatically. Although not limited to any particular material, the connector lid 118 may be made from performance grade stainless steel for enhanced corrosion-resistance and durability.

Referring to FIGS. 1 and 2, the device 100 may include the carrier assembly 105. As shown, the carrier assembly 105 may be disposed within the main housing 102 and the front housing 104. In some embodiments, the carrier assembly 105 may include a connection carrier 128 including a plurality of connection openings 129 for receiving a plurality of electrical terminals 132 such that a first end 131 of the electrical terminals 132 is accessible for engaging corresponding terminals from a mating device. As shown, the electrical terminals may be in the form of female contact sleeves 132 for receiving pins from a mating plug device. As shown, there may be five (5) contact sleeves 132, including a neutral contact sleeve 133, a ground contact sleeve 134, and a phase contact sleeve 135. In some embodiments, the neutral contact sleeve 133, the ground contact sleeve 134, and the phase contact sleeve 135 are staggered to assure an intended break sequence. A second end 136 of the contact sleeves 132 may be inserted into a contact carrier 140. The contact carrier 140 may be coupled to the carrier assembly 105 by any suitable means including, for example, by one or more threaded fasteners. The contact carrier 140 may be manufactured from reinforced nylon, although other suitable materials may be used. Although not further described herein for the sake of brevity, in examples in which the device 100 is a plug or inlet, the electrical terminals 132 may be in the form of pins.

As shown, the contact carrier 140 may include a plurality of contact openings 141 (FIG. 2). The plurality of contact openings 141 may be formed in a first end surface 140A of the contact carrier 140. The plurality of contact openings 141 may be in communication with the plurality of contact sleeves 132. The contact carrier 140 may also include one or more tool openings 144. The tool openings 144 may be formed in a side surface or an outer perimeter 145 of the contact carrier 140. As shown, each of the tool openings 144 may be in the form of an elongated slot, although other shapes are envisioned. In use, the contact carrier 140 may include an equal number of contact openings 141, tool openings 144, and terminals/contact sleeves 132. In use, a tool opening 144 may be in communication with each of the plurality of contact openings 141 and/or contact sleeves 132. The tool openings 144 may extend perpendicular, or substantially perpendicular, to each corresponding contact opening 141 and/or contact sleeve 132. As will be described in greater detail below, each of the tool openings 144 may be provided in the contact carrier 140 to permit access to a set screw 148 by a tool (not shown) such as, for example, a screwdriver, allen wrench, etc. for tightening or loosening the set screw 148 relative to the corresponding contact sleeve 132 to secure the electrical wire within the terminal/contact sleeve 132, while at the same time preventing the set screw 148 from passing through the tool opening 144.

Figure 3:
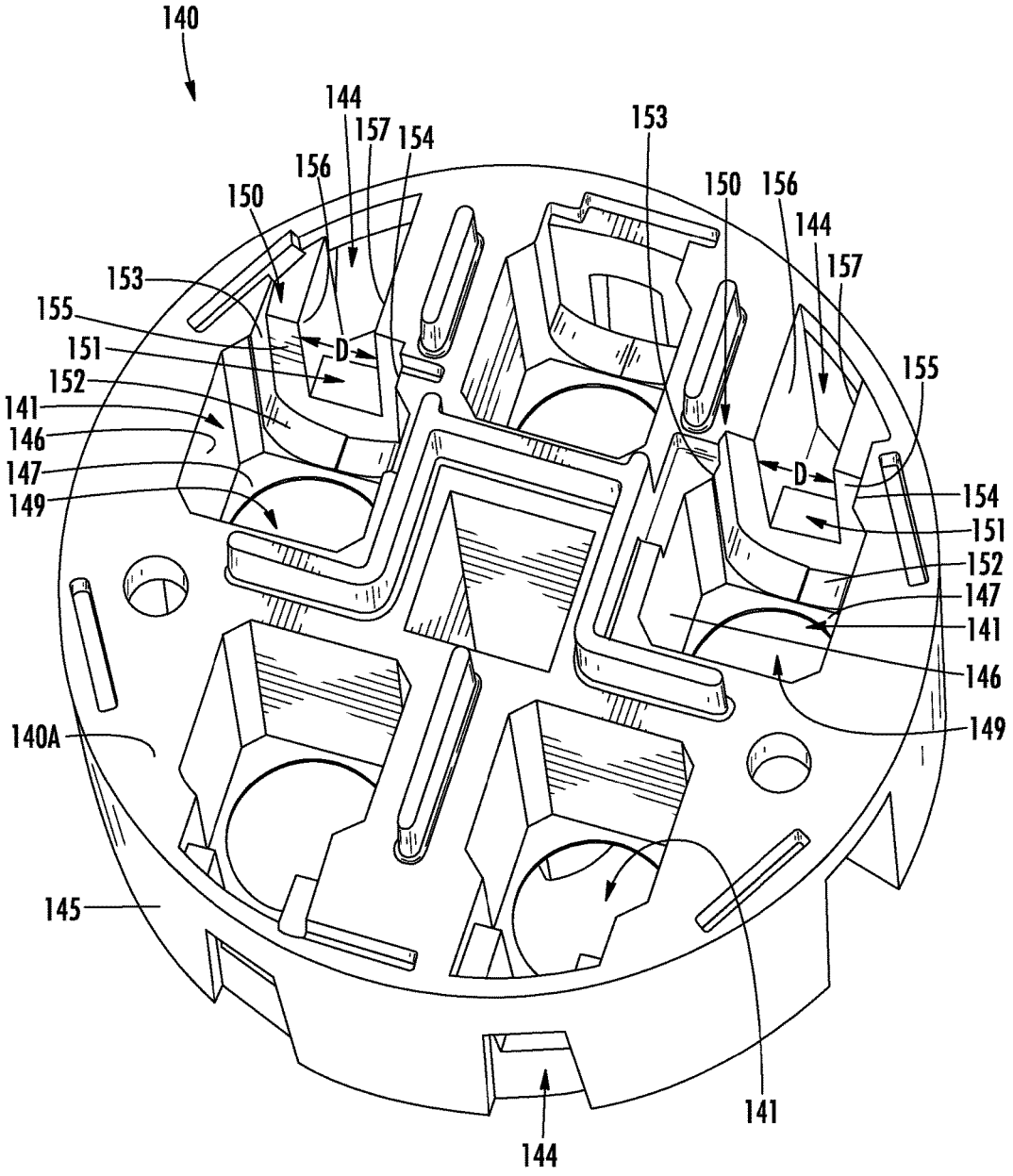
FIG. 3 is a perspective view of one example embodiment of a contact carrier for use with the pin and sleeve device of FIG. 1 according to embodiments of the present disclosure.
Figure 4:
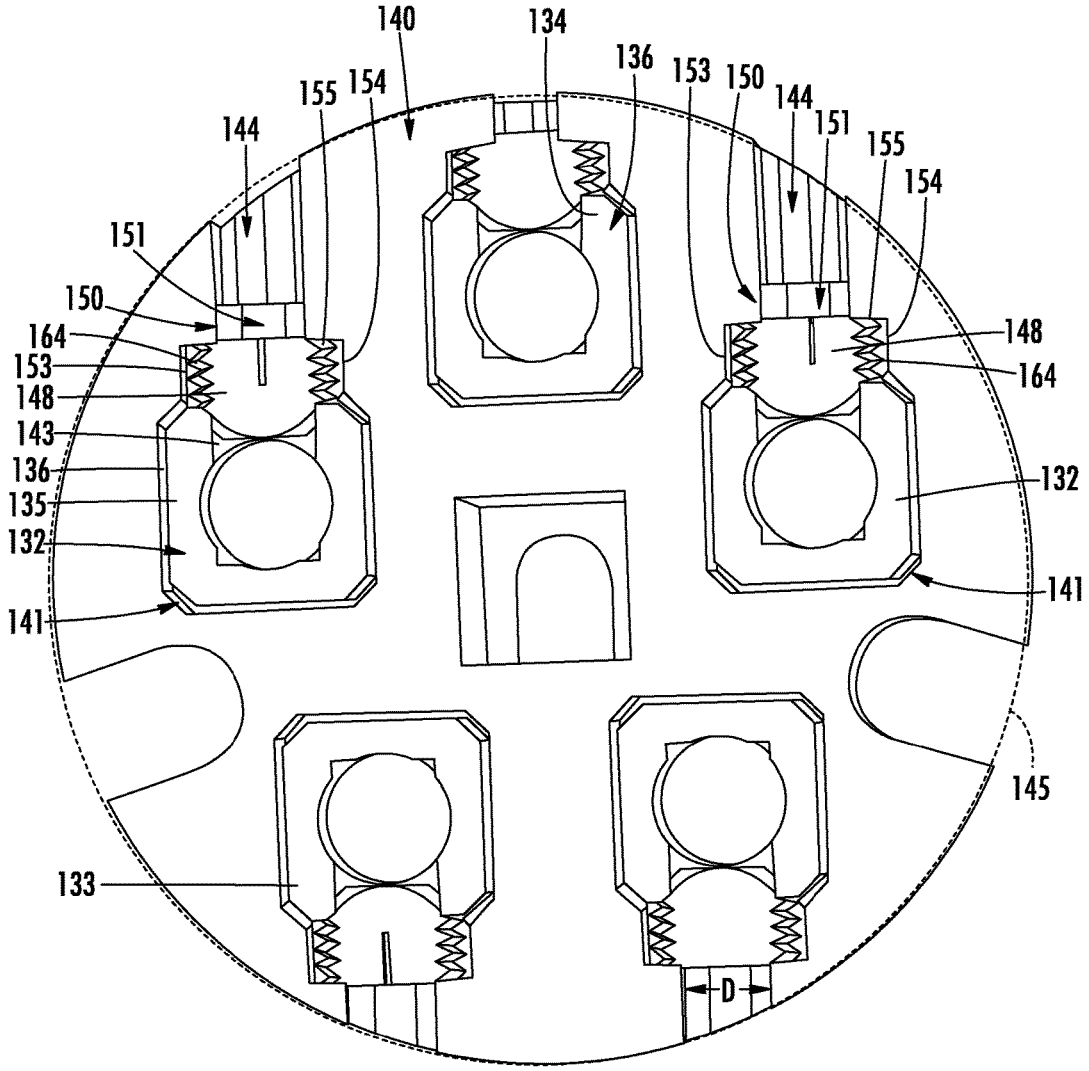
FIG. 4 is a top cross-sectional view of the carrier assembly along line 3-3' of FIG. 2 according to embodiments of the present disclosure.
Figure 5:
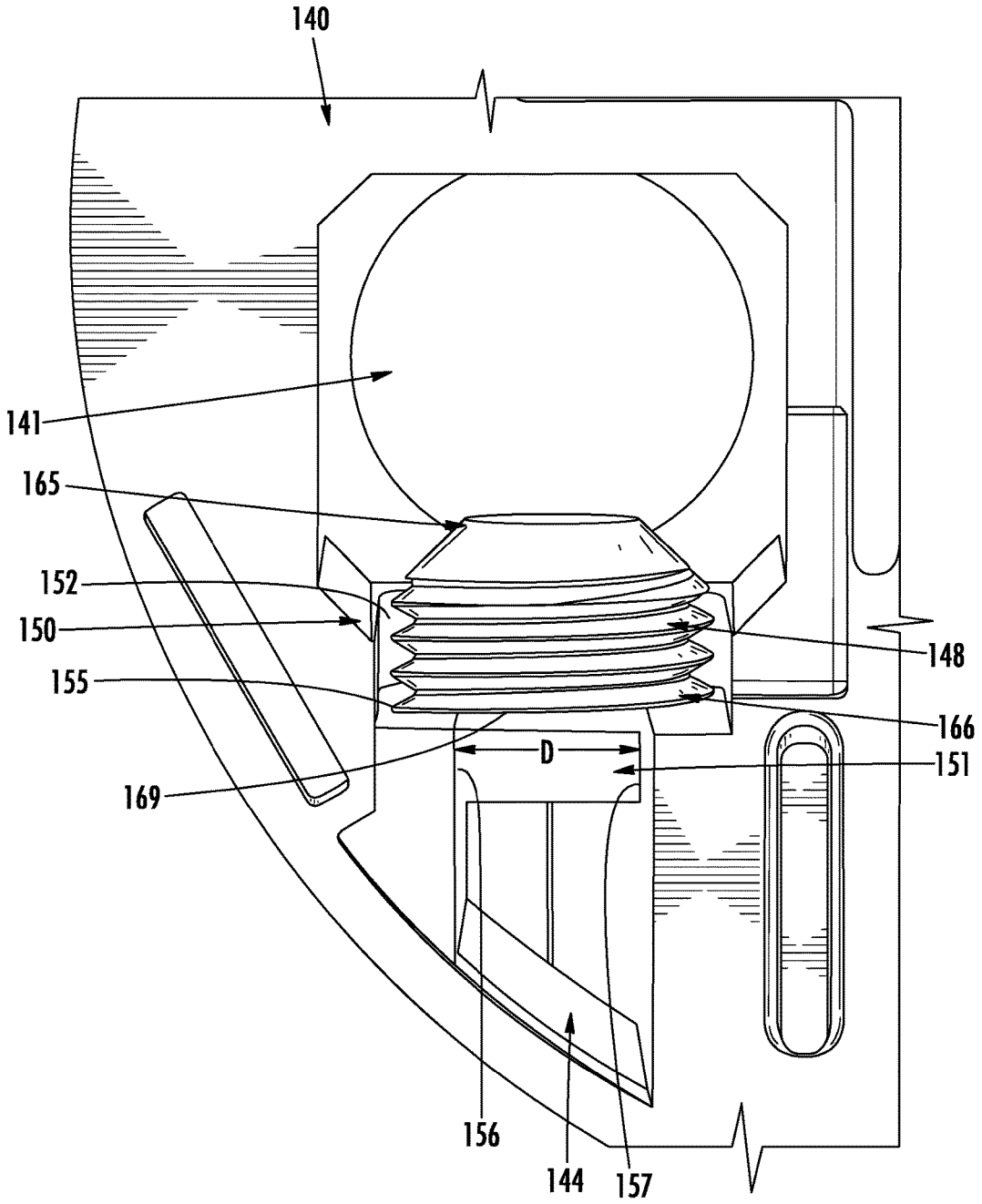
FIG. 5 is a top, partial view of an example embodiment of a screw retainer for use with the contact carrier of the pin and sleeve device of FIG. 1 according to embodiments of the present disclosure.
Figure 6A:
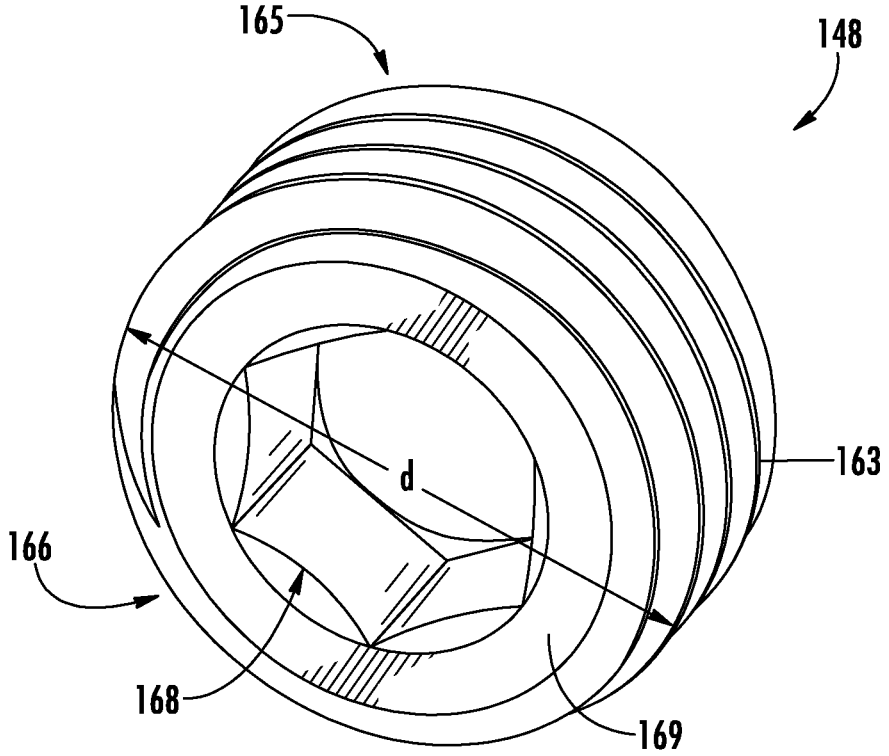
FIG. 6A is a bottom perspective view of an example embodiment of a set screw for use with the pin and sleeve device of FIG. 1 according to embodiments of the present disclosure.
Figure 6B:
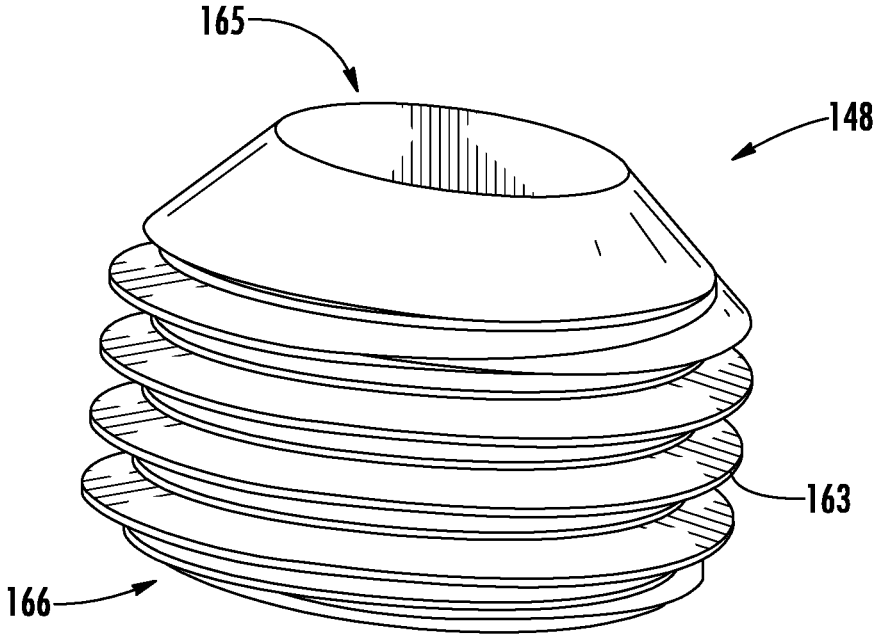
FIG. 6B is a side perspective view of the set screw of FIG. 6A according to embodiments of the present disclosure.

Turning now to FIGS. 3-4, the contact carrier 140 of the pin and sleeve device 100 according to embodiments of the present disclosure will be described in greater detail. As shown, the contact carrier 140 may include one or more contact openings 141 each receiving one of the plurality of contact sleeves 132 (neutral contact sleeve 133, ground contact sleeve 134, phase contact sleeve 135) so that each of the contact openings 141 is in communication with one of the contact sleeves 132. The contact openings 141 and/or contact sleeves 132 may also be in communication with the corresponding tool openings 144, which extends from the side surface 145 of the contact carrier 140. Each of the contact openings 141 may include a set of sidewalls 146 and a base wall 147 defining a central cavity 149. The set of sidewalls 146 and the base wall 147 of each contact opening 141 are configured to receive the second end 136 of each corresponding contact sleeve 132, wherein the set of sidewalls 146 and the base wall 147 may be arranged perpendicular to one another. In some embodiments, the second end 136 of each contact sleeve 132 may be a box terminal, which may include an internally threaded surface 143 engaged with threading 164 of the set screw 148. As shown, the base wall 147 may be configured to prevent the contact sleeve 132 from passing completely though the contact carrier 140. In some embodiments, an opening may be provided in the base wall 147 to receive the contact sleeve 132.

The contact carrier 140 may further include one or more screw retainers 150 defining a screw access channel 151 aligned with each corresponding tool opening 144. The screw access channel 151 may be in communication with the central cavity 149 and with the tool opening 144. In some embodiments, the screw retainer 150 may include a contoured surface 152 configured to engage/support the set screw 148, and a retainment wall 155 extending from the contoured surface 152. As shown, each screw retainer 150 may further include a pair of sidewalls 153, 154 extending from the contoured surface 152. The pair of sidewalls 153, 154 may extend parallel, or substantially parallel, to one another on opposite sides of the set screw 148 to help maintain a position of the set screw 148 within the contact opening 141.

During use, when the set screw 148 is present within (e.g., protruding into) the contact opening 141, the set screw 148 may be positioned directly adjacent the retainment wall 155 and the contoured surface 152. The set screw 148 may be prevented from passing through the tool opening 144 formed in the outer perimeter or side surface 145 of the contact carrier 140 as the dimensions of the retainment wall 155 and the screw access channel 151 do not permit the relatively larger sized set screw to pass therethrough. More specifically, a pair of access channel sidewalls 156, 157 defining the access channel 151 may be separated by a distance 'D' that is smaller than a diameter of the head of the set screw 148 so that the set screw 148 is maintained in position between the retainment wall 155 and the corresponding contact sleeve 132. As a result, in exemplary embodiments, the set screw 148 may be positioned entirely within the outer perimeter 145 of the contact carrier 140 such that no portion of the set screw 148 protrudes beyond any outermost exterior surfaces of the contact carrier 140.

Turning now to FIGS. 4, 5, and 6A-B, an exemplary screw retainer 150 of the contact carrier 140 according to embodiments of the disclosure will be described in greater detail. The screw retainer 150 includes the screw access channel 151 aligned with and extending from the tool opening 144. The exemplary set screw 148 is shown extending into the contact opening 141. In some embodiments, the set screw 148 may include threading 163 extending between a first end 165 and a second end 166, wherein the first end 165 is configured to engage/enter the contact sleeve 132, for example, as demonstrated in FIG. 4. The second end 166 of the set screw 148 may include a socket drive 168, such as a hexagonally-shaped internal socket drive, which is aligned with the tool opening 144. The socket drive 168 may be engaged by a tool (not shown), which enters the contact carrier 140 through the tool opening 144. It will be appreciated that the set screw 148 may include a variety of different drive configurations in other embodiments.

As shown, the set screw 148 is positioned directly adjacent the retainment wall 155 and the contoured surface 152, the retainment wall 155 facing towards the central cavity 149 and away from the tool opening 144. In some embodiments, the contoured surface 152 and the retainment wall 155 define an inner portion of the central cavity 149 of the contact opening 141. The second end 166 of the set screw 148 may include an end wall surface 169 facing the retainment wall 155. As shown, the retainment wall 155 may be generally U-shaped, split by the screw access channel 151. The screw access channel 151 may be partially defined by the pair of access channel sidewalls 156, 157, which may be oriented perpendicularly to the retainment wall 155. In exemplary embodiments, the distance 'D' between the pair of access channel sidewalls 156, 157 is less than a diameter 'd' of the set screw 148. As a result, the end wall surface 169 engages the retainment wall 155 to restrict movement of the set screw 148 towards the tool opening 144, while the distance 'D' of the access channel 151 permits access to the socket drive 168. Therefore, the set screw 148 is unlikely to fall out of the contact carrier 140 due to the position of the set screw 148 between the retaining wall 155 and the contact sleeve.

In sum, provided herein are pin and sleeve devices including set screws advantageously held captive within the contact carrier. Furthermore, a wire (not shown) secured to each contact sleeve can be removed and attached without complete removal of the set screw, thus advantageously reducing assembly wiring time.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features. In addition, for the sake of convenience and clarity, terms such as "front," "rear," "outer," "inner," "top," "bottom," "upper," "lower," "upwards," "downwards," "vertical," "horizontal," "lateral," "longitudinal," "height," and "width" may have been used herein to describe the relative placement and orientation of the device and its various components, each with respect to the geometry and orientation of the device as it appears in the figures.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A pin and sleeve device, comprising:

a housing; and a contact carrier within the housing, the contact carrier including a plurality of contact openings each receiving a terminal, the contact carrier further including a tool opening extending between an outer perimeter and a first contact opening of the plurality of contact openings; and a set screw positioned within the first contact opening of the plurality of contact openings, the set screw including a plurality of threads extending between a first end and a second end, the first end being operable to engage the terminal, the second end including a tool drive aligned with the tool opening, the set screw positioned directly adjacent a retainment wall defining a portion of the first contact opening of the plurality of contact openings, the retainment wall operable to prevent the set screw from passing through the tool opening;

wherein:

the contact carrier further includes a screw retainer defining a screw access channel aligned with the tool opening, the screw retainer including a contoured surface extending from the retainment wall, wherein the set screw is supported by the contoured surface; and the terminal is a box terminal of a contact sleeve, the box terminal positioned within the first contact opening of the plurality of contact openings.

2. The pin and sleeve device of claim 1, wherein the first contact opening of the plurality of contact openings including a central cavity defined by a set of sidewalls and a base wall.

3. The pin and sleeve device of claim 1, wherein the screw retainer further including a pair of sidewalls extending from the contoured surface, wherein the pair of sidewalls extend substantially parallel to one another on opposite sides of the set screw.

4. The pin and sleeve device of claim 1, wherein a distance between a pair of access channel sidewalls defining the screw access channel is less than a diameter of the set screw.

5. The pin and sleeve device of claim 1, wherein the tool drive is a hexagonally shaped internal socket drive.

6. The pin and sleeve device of claim 1, wherein the second end of the set screw includes an end wall surface facing the retainment wall of the screw retainer.

7. The pin and sleeve device of claim 1, the box terminal including an internally threaded surface operable to engage the plurality of threads formed on the set screw.

8. The pin and sleeve device of claim 1, wherein the terminal is one of: a pin, and a contact sleeve.

9. A contact carrier of a pin and sleeve device, the contact carrier comprising:

a contact sleeve having a box terminal at a first end thereof;

a contact opening receiving the box terminal of the contact sleeve;

a tool slot extending from an outer circumferential perimeter to the contact opening; and a screw retainer defining a screw access channel aligned with the tool slot, the screw retainer including a contoured surface and a retainment wall defining an inner portion of the contact opening, wherein a set screw is positioned within the contact opening, directly adjacent the retainment wall and the contoured surface, and wherein the set screw is positioned entirely within the outer circumferential perimeter, the set screw being arranged and configured to engage the box terminal of the contact sleeve.

10. The contact carrier of claim 9, the contact opening including a set of sidewalls and a base wall defining a central cavity, wherein the central cavity is fluidly connected with the screw access channel.

11. The contact carrier of claim 10, wherein the retainment wall faces the central cavity of the contact opening.

12. The contact carrier of claim 9, the screw retainer further including a pair of sidewalls extending from the contoured surface, wherein the pair of sidewalls extend parallel to one another on opposite sides of the set screw.

13. The contact carrier of claim 9, further comprising a pair of access channel sidewalls defining the access channel, wherein a distance between the pair of access channel sidewalls is shorter than a diameter of the set screw to prevent the set screw from entering the tool slot.

14. The contact carrier of claim 9, the set screw including a threading extending between a first end and a second end, wherein the first end is operable to engage the box terminal of the contact sleeve, and wherein the second end includes an internal socket drive aligned with the screw access channel.

15. The contact carrier of claim 14, wherein the second end of the set screw includes an end wall surface facing the retainment wall.

16. A pin and sleeve device, comprising:

a housing; and a contact carrier within the housing, the contact carrier comprising:

a contact sleeve including a box terminal at an end thereof;

a contact opening receiving the box terminal of the contact sleeve;

a tool slot extending from an outer circumferential perimeter to the contact opening; and a screw retainer defining a screw access channel aligned with the tool slot, the screw retainer including a contoured surface and a retainment wall defining an inner portion of the contact opening; and a set screw positioned within the contact opening and the screw access channel, the set screw positioned directly adjacent the retainment wall and the contoured surface, the retainment wall operable to prevent the set screw from entering into the tool slot;

wherein the set screw includes a first end, a second end, and threads between the first and second ends, the first end of the set screw being operable to engage the box terminal of the contact sleeve positioned within the contact opening.

17. The pin and sleeve device of claim 16, the contact opening including a central cavity defined by a set of sidewalls and a base wall.

18. The pin and sleeve device of claim 16, the screw retainer further including a pair of sidewalls extending from the contoured surface, wherein the pair of sidewalls extend substantially parallel to one another on opposite sides of the set screw.

19. The pin and sleeve device of claim 16, wherein a distance between a pair of access channel sidewalls defining the screw access channel is shorter than a diameter of the set screw.

20. The pin and sleeve device of claim 16, wherein the second end includes an internal socket drive aligned with the tool slot.

21. The pin and sleeve device of claim 20, wherein the second end of the set screw includes an end wall surface facing the retainment wall of the screw retainer.

22. The pin and sleeve device of claim 16, the box terminal including an internally threaded surface operable to engage the threading of the set screw.

* * * * *